US006276236B1

(12) United States Patent
Wu

(10) Patent No.: US 6,276,236 B1
(45) Date of Patent: Aug. 21, 2001

(54) CLAMP APPARATUS

(76) Inventor: Pi-Liang Wu, P.O. Box 55-175, Taichung (TW)

( * ) Notice: Subject to any disclaimer, the term of this patent is extended or adjusted under 35 U.S.C. 154(b) by 0 days.

(21) Appl. No.: 09/455,481

(22) Filed: Dec. 6, 1999

(51) Int. Cl.[7] ..... B25B 27/10

(52) U.S. Cl. ..... 81/9.3; 81/485; 81/347; 81/353

(58) Field of Search ..... 81/9.3, 485, 483, 81/347, 352, 353, 354, 355, 129, 150; 269/43; 228/49.3

(56) References Cited

U.S. PATENT DOCUMENTS 5,253,554 * 10/1993 Riera et al. .

5,507,206 * 4/1996 Solski .

* cited by examiner

*Primary Examiner*—Timothy Eley
*Assistant Examiner*—Willie Berry, Jr.

(57) ABSTRACT

The present invention is regarding to a structural improvement of a clamp which includes a flex attached to a handle set, an actuator cable extends through the slider and is linked to gripper device, of which the openings and open notch are built in, it offers a convenient scheme for operator to detach or engage actuator cable from gripper device, by simple operation, gripper devices may be conveniently interchanged in order to meet versatile needs in various situations.

2 Claims, 5 Drawing Sheets

CLAMP APPARATUS

BACKGROUND OF THE INVENTION

The present invention relates to a clamp and more particularly to a structural improvement of a clamp for the hose-clips which comprising a handle set, a flex, an actuator cable and a gripper device, the actuator cable may separate and engage with the gripper device in a simple manor through a pair of opening and an open notch built in the gripper device in order to meet the operation requirements.

In the pipe or hose design, e.g. the pneumatic or the oil pipe, often the pipes must connect to each other or to a designated hose-clip. Therefore all the connections between the pipes and the connectors must be tightly tied up by a hose-clip or pushed together to prevent loosen connection or unexpected leakage. However the terminal connectors may be well buried deeply in the complex the pipe layout or in restricted space. In order to reach it with the tools or hands, operators must depend on special tools to complete the work.

A mechanism of the clamp for the hose-clips designed to loose or install the pipes applies via a control cable between the clamp and the gripper set to loose up the pipes by the displacement of the control cable actuated by the clamp.

But the control cable and the gripper set are built as a whole piece. Depends on which kind of the gripper is attached, each of the clamp gives a specified operational function. In reality the pipes may disconnect from each other and from the connectors as well. Operator thus inconveniently has to carry several different kinds of the clamps in cases hand-unreachable locations are encountered. Thus an interchangeable the gripper set design would be practical.

In addition, there might not be sufficient working space for the gripper set once the gripper set reaches the pipe location. Operator has to maneuver the control cable in order to align the gripper set with the pipe. The cable is twisted and un-smooth accordingly. It thus degrades the capability of the cable in controlling the gripper set when operator applies maneuvering. The handle set easily yields unexpected attitudes due to the fixed configuration between the handle set and the control cable. It is hard for operator to the handle. The existing the clamp mechanisms are inaccurate and hard-to-handle under these conditions. It needs improvements.

The present invention is arisen to militate and/or obviate the aforediscussed disadvantage in order to provide a new and novel structure hereinafter.

SUMMARY OF THE PRESENT INVENTION

The present invention has a main object to provide a structural improvement of a clamp which includes a handles set, a flex, an actuator cable and a gripper device, a pair of openings and an open notch are built in the gripper device for the actuator cable interchanging, separation and adjoining.

Another object of the present invention is to provide a structural improvement of a clamp which provides an interchangeable integration among the flex, the actuator cable and the handle set, the handle set and the actuator cable maintain angular motion to each other and, thus, the actuator cable stays smooth and the handle set stays in operational attitude.

The present invention will become more fully understood by reference to the following detailed description thereof when read in conjunction with the attached drawings.

DETAILED DESCRIPTION OF THE PREFERRED EMBODIMENTS

Figure 1:
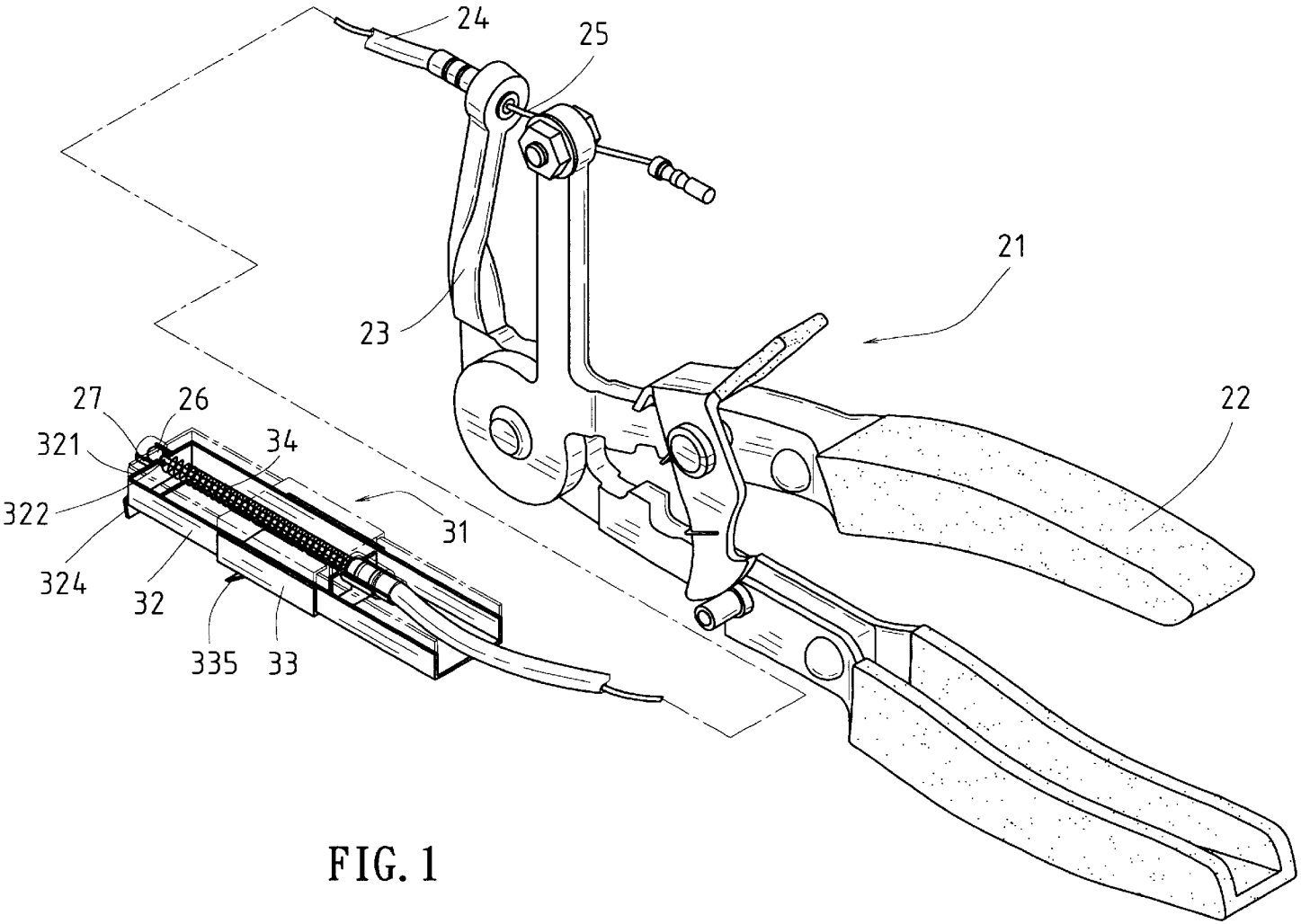
FIG. 1 is a perspective view to show the present invention.
Figure 2:
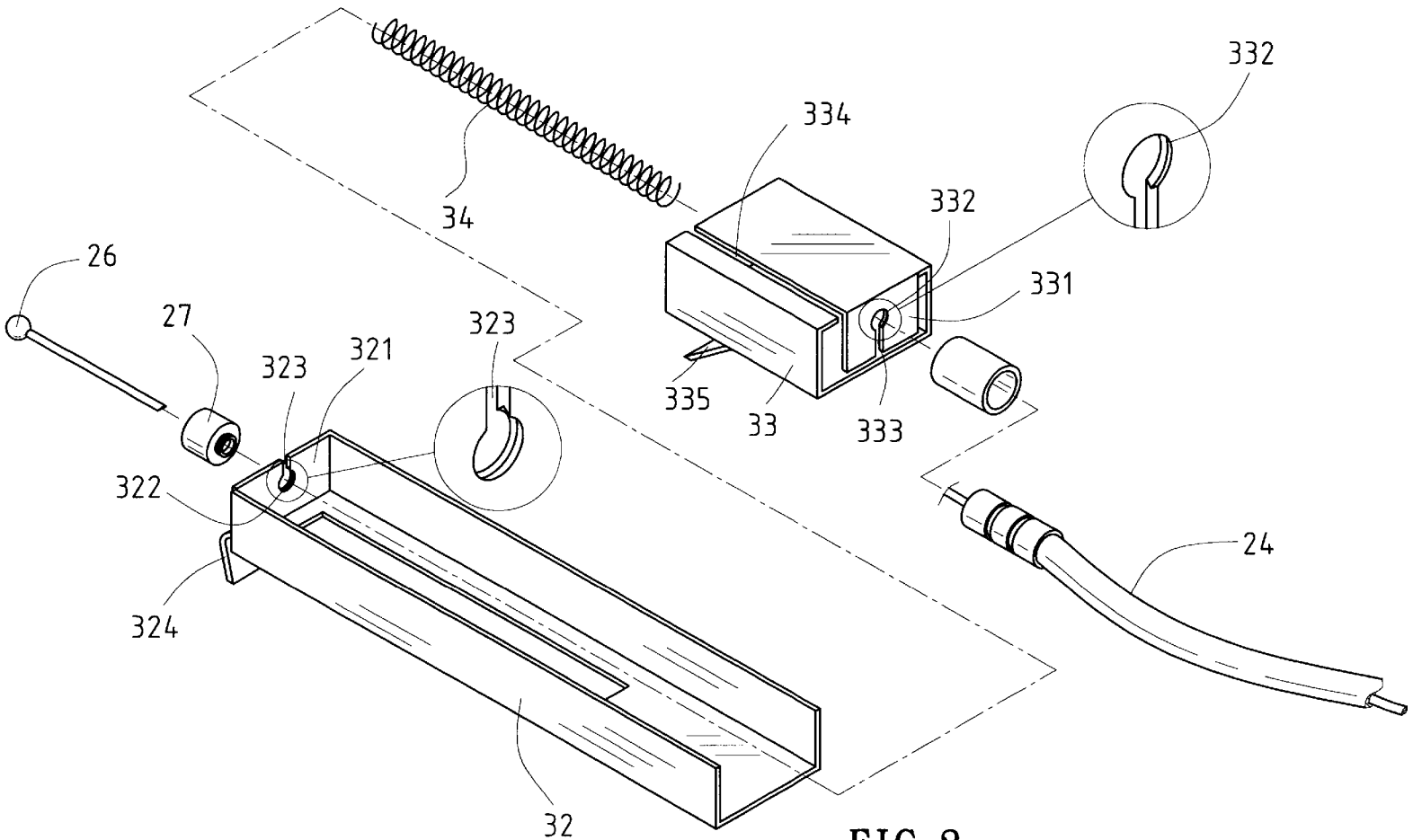
FIG. 2 is an exploded perspective view to show the gripper device of the present invention.
Figure 3:
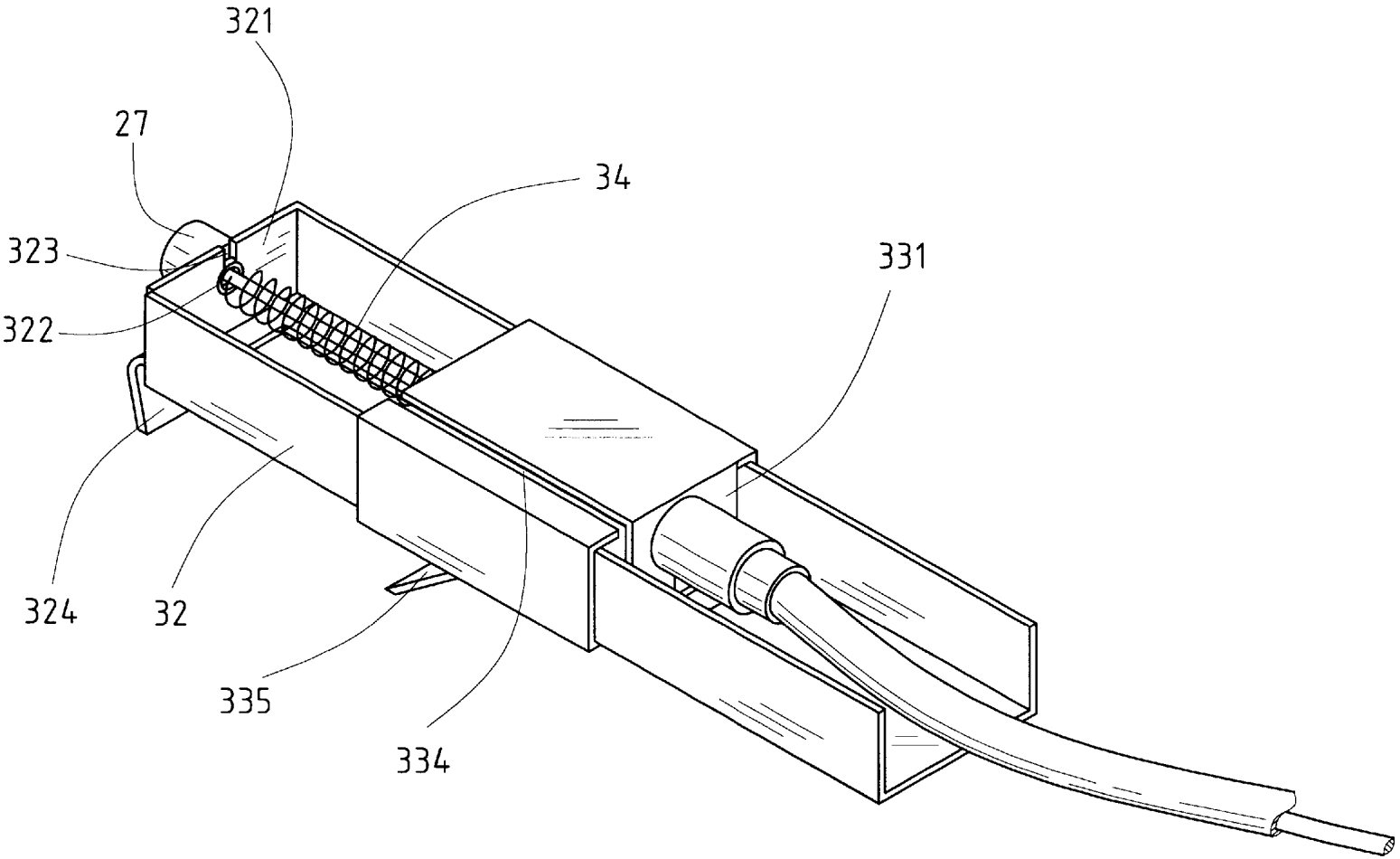
FIG. 3 is an assembled perspective view to show the gripper device of the present invention.

Please refer to FIGS. 1, 2 and 3, the present invention, a structural improvement of a clamp comprises a handle set 21 having a pair of handles 2 a gripper device 31 and an actuator cable 25 in a flex 24. The handle 22 and an actuator 23 are at the two ends of the handle set 21 and act on each other, a blocker 26 is attached to the end of the actuator cable 25 which runs through the flex 24 fixed to the actuator 23, the blocker 26 is restrained on a terminal piece 27 screwed at the forward end of a slider base 32.

The gripper device 31 includes base 32 mounted with a spring 34 and a connected slider 33, the sectional view of the slider base 32 appears in a U-shaped, a first opening 323 set for linking the slider base 32 is placed above a fastening hole 322 which locates at a forward end 321 of the slider base 32, also there is a first protruding tab 324 at the outer side of the bottom.

A stopper 331 locates at the end of the slider 33, a slider-fastening hole 332 appears at the stopper 331, a second opening 333 connects to the slider-fastening hole 332, there is also an open notch 334 on the surface of the slider 33 (as shown in the FIG. 2 of the slider), there is also a second protruding tab 335 placed at the bottom of the slider 33.

According to the above, the fastening hole 322 at the end of the gripper device 31 on the slider base 32 restrains the position of the blocker 26 at the terminal end of the actuator cable 25 of the handle set 21, the actuator cable 25 runs through the slider fastening hole 332 on the stopper 331 of the slider 33. It tightly attaches the flex 24 to the slider-fastening hole 332, and thus places the second protruding tab 335 on the slider 33 and the first protruding tab 324 on the handle set 32 against each other. The actuator cable 25 is actuated by the actuator 23 while the handle 22 on the handle set 21 is pushed. The slider 23 slides on the slider base 32 and there is a relative displacement between the second protruding tab 335 and the first protruding tab 324.

The actuator cable 25 may easily travel through the first opening 323 on the fastening hole 322, the open notch 334 on the slider 33 and the second opening 333 on the slider-fastening hole 332. Thus it helps to integrate the actuator cable 25, the slider base 32 and the slider 33 together.

In operating of the present invention, applying the second protruding tab 335 and the first protruding tab 324 on a pipe or a hose, the pipe is loosened due to the relative displacement and resultant force between the second protruding tab 335 and the first protruding tab 324.

Figure 4:
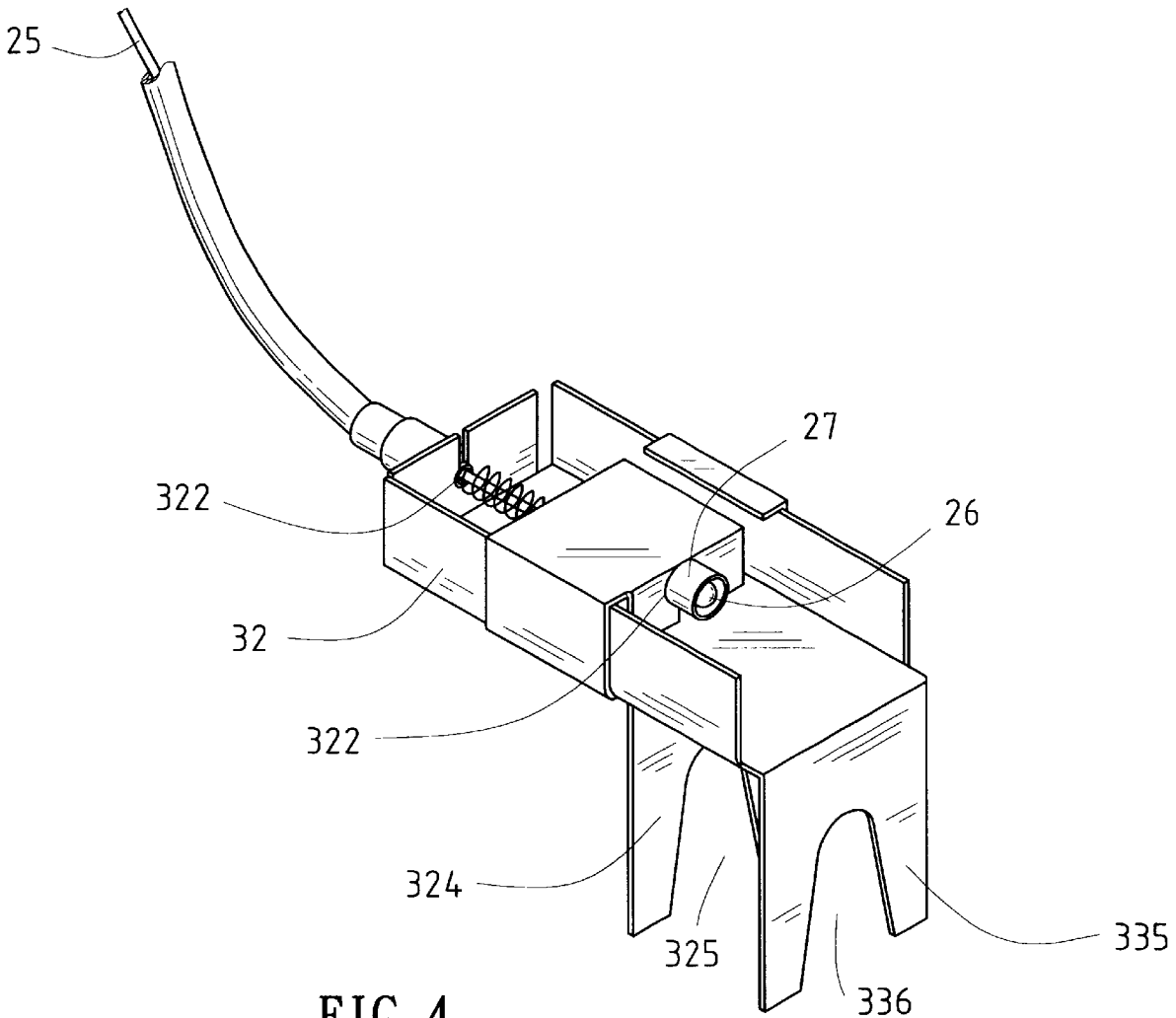
FIG. 4 is a perspective view to show the second embodiment of the gripper device of the present invention.

Please also refer to FIG. 4 for the second embodiment of the present invention. The gripper device 31 is attached to the slider base 32 through the slider 33. There is the fastening hole 322 and the first opening 323 on the foward end 321 of the slider base 32. The first protruding tab 324 is attached to the bottom of the slider base 32. Also the open notch 334, the stopper 331, the fastening hole 322, the second opening 333 and the second protruding tab 335 are built into the slider 33, the first protruding tab 324 and the second protruding tab 335 are dentate. A pair of concave notches 325 and 336 are on each one of them.

Figure 5:
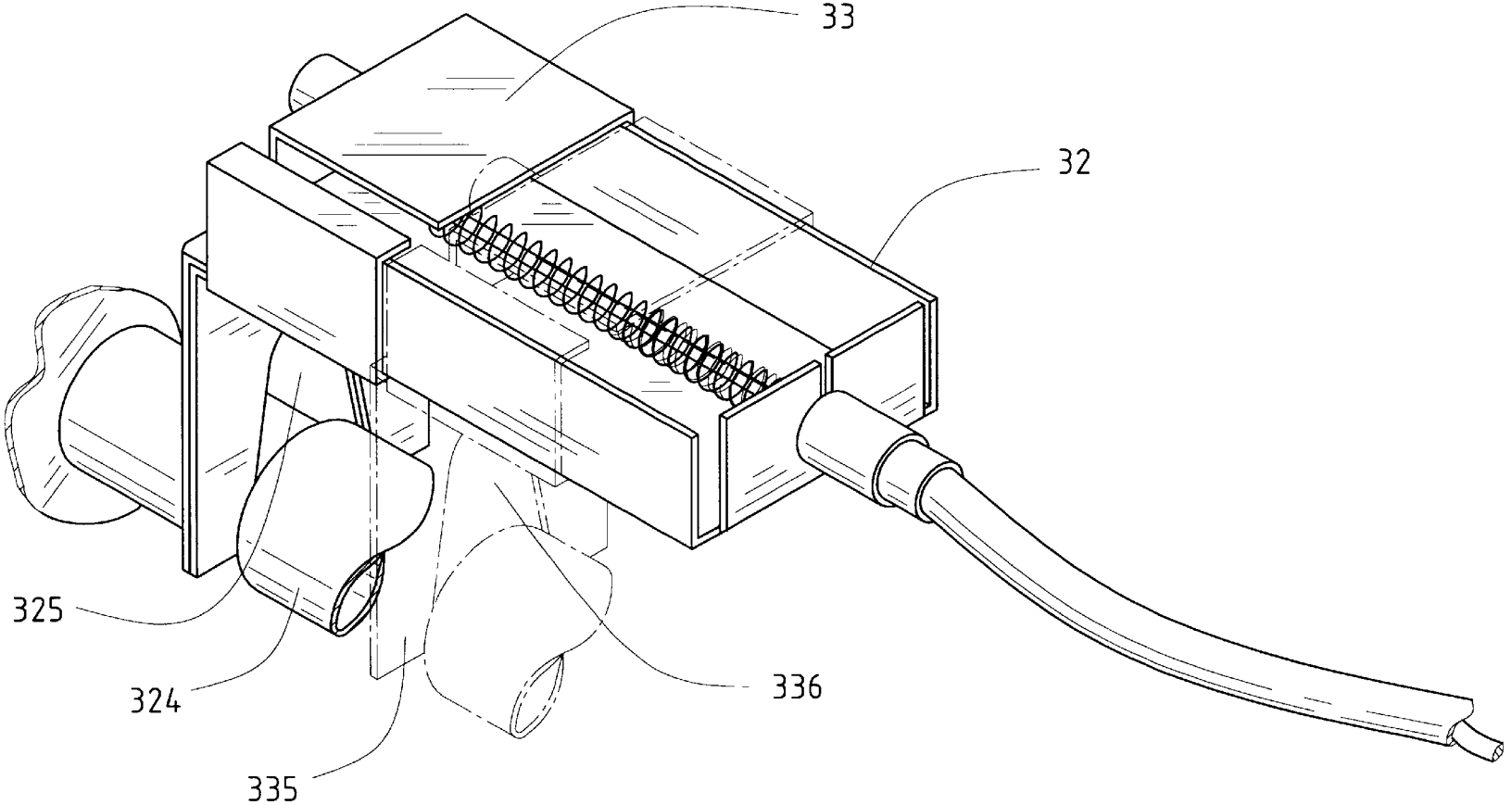
FIG. 5 is a perspective view to show the second embodiment facilitate in a pipe.

Refer to FIG. 5 for the second embodiment of the present invention. The blocker 26 at one end of the actuator cable 25 is attached to the fastening hole 322 of the slider 33. The other end of the actuator cable 25 runs through the slider-fastening hole 332 of the slider base 32. It attaches to the handle set 21 and the first protruding tab 324 and the second protruding tab 335 at their locations on pipe. Held by the notches 325 and 336 of the first protruding tab 324 and the second protruding tab 335, the cable maneuvering generates displacement and force between the first protruding tab 324 and the second protruding tab 335, and thus detaches the connected pipe.

It is worthy of mentioning that different kinds of the gripper device 31 may conveniently be attached or disengaged from the actuator cable 25 due to the first and second openings 323 and 333 and the open notch 334 designed for the actuator cable 25, the slider base 32 and the slider 33. Operator may conveniently replace different kinds of the gripper device 31 for various pipes.

The handle set 21 and the flex 24 are linked but not fixed, the handle set 21 and the flex 24 may rotate with respect to each other. When the gripper device 31 enters an hand-unreachable working space (e.g. automobile engine combustion chamber), the twisted the flex 24 on the gripper device 31 may yield impaired the actuator cable 25 or poor handling attitude of the handle set 21. With the help of the rotation flexibility between the handle set 21 and the flex 24, it may be used to adjust the twisted the actuator cable 25 and the poor attitude of the handle set 31.

In general this invention adopts handle set, gripper device, flex and actuator cable to implement pipe clamp. By the designated openings and open notch on gripper device, the actuator cable may quickly separate from and attach to different kinds of gripper device. It also maintains a smooth actuator cable and excellent handle attitude of handle set.

Note that the specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A clamp comprising:

a handle set including a pair of handles and an actuator, the pair of handles and the actuator linked with each other, a flex having one end secured to the actuator of the handle set, an actuator cable having a predetermined length which extends through the flex, one end of the actuator cable secured to a blocker, the other end of the actuator cable secured to the actuator of the handle set, a gripper device including a slider slidably mounted on a slider base with a spring mounted between the slider and the slider base, a fastening hole defined in an end face of the slider base, a first opening defined in the end face of the slider base and communicating with the fastening hole, a first protruding tab protruding outward from a bottom of the slider base, the slider having one end provided with a stopper, a slider-fastening hole defined in the stopper, a second opening defined in stopper and communicating with the slider-fastening hole, an open notch defined in a surface of the slider, a second protruding tab protruding outward from a bottom surface of the slider, wherein, the actuator cable in turn extends through the first and second openings, the open notch, the fastening hole, and the slider-fastening hole while the flex is fixed in the slider fastening hole such that the gripper device and the actuator cable are integrally connected with each other.

2. A clamp as recited in claim 1 wherein said gripper device further has a U-shaped slider base.

* * * * *